US010149563B2

(12) United States Patent
Chapin et al.

(10) Patent No.: US 10,149,563 B2
(45) Date of Patent: Dec. 11, 2018

(54) TRANSPORTABLE CAKE CARRIER

(76) Inventors: Julianne Margolis Chapin, Wakefield, RI (US); Scott Chapin, Wakefield, RI (US)

( * ) Notice: Subject to any disclaimer, the term of this patent is extended or adjusted under 35 U.S.C. 154(b) by 823 days.

(21) Appl. No.: 12/724,765

(22) Filed: Mar. 16, 2010

(65) Prior Publication Data

US 2011/0226659 A1 Sep. 22, 2011

(51) Int. Cl.
*A47G 19/26* (2006.01)

(52) U.S. Cl.
CPC ..... *A47G 19/26* (2013.01)

(58) Field of Classification Search
CPC ... A23G 3/34; A23G 3/50; A23G 3/56; A23G 3/563; A23G 9/00; A23G 9/48; A23G 9/503; G11B 33/045; A21D 13/00; A21D 13/0067; A21D 13/0087; A21D 13/009; A21D 13/0045; B65D 5/42; B65D 5/44; B65D 5/50; B65D 5/5028; B65D 7/24; B65D 11/18; B65D 11/1866; B65D 11/1873; B65D 25/10; B65D 25/102; B65D 25/106; B65D 85/00; B65D 85/30; B65D 85/36; B65D 85/60; B65D 2581/00; B65D 2581/02; B65D 2581/05; B65D 2581/051; B65D 2581/058; B65D 2585/00; B65D 2585/36; A45F 3/46; A45C 11/20; A47J 47/02; A47J 47/14
USPC ..... 426/106, 112, 115, 132, 104; 206/541, 206/542, 493, 525; 312/284; 62/457.9; 220/4.33, 4.34, 592.25, 592.26, 592.27; 224/615, 258, 625
See application file for complete search history.

(56) References Cited

U.S. PATENT DOCUMENTS

| | | | | | |
|---|---|---|---|---|---|
| 1,163,696 | A | * | 12/1915 | Silberman | 220/4.33 |
| 1,883,553 | A | * | 10/1932 | Chain | 220/4.34 |
| 3,843,220 | A | | 10/1974 | Snider | |
| 3,957,327 | A | | 5/1976 | Parrish | |
| 4,866,572 | A | * | 9/1989 | Blodgett | 361/735 |
| 5,248,081 | A | * | 9/1993 | Hook | 229/117.14 |
| 5,279,436 | A | * | 1/1994 | Elliott et al. | 220/1.5 |
| 5,399,408 | A | * | 3/1995 | Nowara | 428/73 |
| 5,800,061 | A | * | 9/1998 | Volles | 383/15 |
| 6,112,894 | A | * | 9/2000 | Kikuchi et al. | 206/308.1 |
| 6,364,186 | B1 | * | 4/2002 | Gilmour et al. | 224/637 |

(Continued)

OTHER PUBLICATIONS

Bushing definition, http://www.oed.com/oed2/00029946, 1989.*

*Primary Examiner* — Erik Kashnikow
*Assistant Examiner* — Chaim Smith
(74) *Attorney, Agent, or Firm* — Lyman Smith; Kenneth Bower

(57) ABSTRACT

Disclosed is a transportable cake carrier that protects tall, multilayer pastry products from the perils of unexpected turns, uneven pavement, pot-holes and sudden stops of the vehicles doing the delivery. In addition to vehicle borne perils the new and unique carrier addresses ease of placement and removal of the pastry from the carrier, keeping the pastry refrigerated and placement and removal of the carrier from the vehicle. A unique combination of tying the top, base, pedestal and layer separators firmly together, with a sturdy, easy to clean and reusable housing and outstanding human engineering make transport damage a thing of the past. In addition this unique carrier fulfills the spirit of federal LEEDs sustainability requirements with completely reusable components and by keeping ruined product out of the landfills.

15 Claims, 5 Drawing Sheets

(56) References Cited

U.S. PATENT DOCUMENTS

Figure 1:
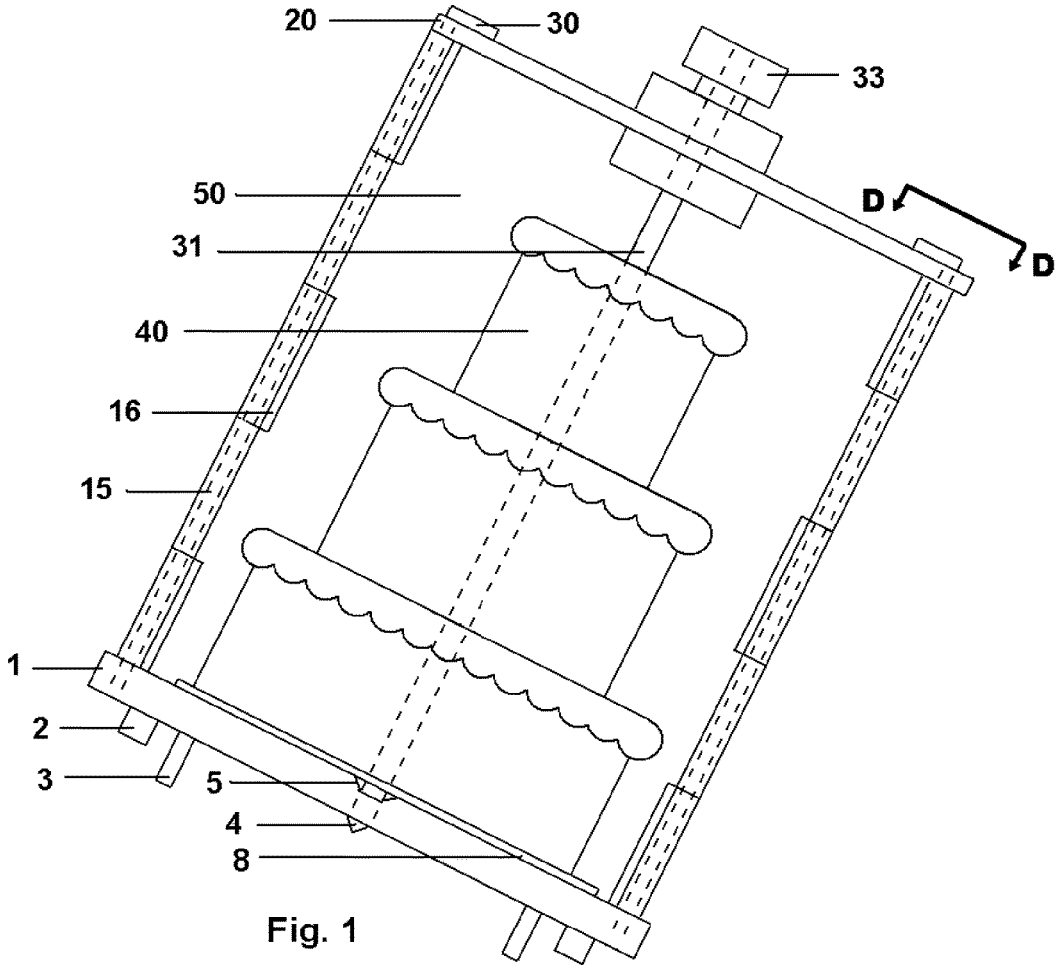

| | | | | |
|---|---|---|---|---|
| 6,799,434 | B1 * | 10/2004 | Hobbs, Jr. | 62/457.9 |
| 2004/0222121 | A1 * | 11/2004 | Horton | 206/525 |
| 2007/0280807 | A1 * | 12/2007 | Threet et al. | 414/462 |
| 2008/0017533 | A1 * | 1/2008 | Hong | 206/307.1 |
| 2009/0148569 | A1 * | 6/2009 | Aya | 426/104 |
| 2009/0321288 | A1 * | 12/2009 | Arun et al. | 206/308.1 |

* cited by examiner

TRANSPORTABLE CAKE CARRIER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

This patent application is for an apparatus and method of use in the field of carriers for edible products.

The present invention represents a significant step forward in the field of transportation of fragile pastry products. Known devices intended for this purpose are limited to transporting pastry products or pastry product layers that are considerably shorter than they are high. Other known cake carriers lack the physical stability to withstand unexpected turns, uneven pavement, pot holes and sudden stops of the delivery vehicle that causes lateral sliding or tilting of the pastry product during transport.

PRIOR ART

The following is art representative of publications in the field of transporting pastry. Published Application Number US 2004/0222121 to inventor Horton discloses a system and method for transporting food. Horton's system has a top, base and sides comprising a cardboard box with inserts and a pointed rod. However, the disclosure of inventor Horton creates potential problems by removing the cake from the top of the carrier promoting hand contact with the frosting. Horton also lacks a provisions to insure vertical insertion of the pointed rod into the cake. Horton's pointed rod contacts the carrier upon removal transferring pastry material to the carrier making cleaning difficult. The bottom of Horton's pointed rod is held in place at the tip of the rod piercing a cardboard separator allowing inadvertent shifting of the cake. Horton also does not provide for optional passive or active cooling devices. Nor does Horton fulfill sustainability goals by providing any re-use and ease of cleaning and sanitizing due to the cardboard box construction. Lastly Horton does not provide for ease of carrying and avoidance of ruined cakes reaching the landfill to satisfy federal LEEDs standards.

U.S. Pat. No. 3,957,327 to inventor Parrish discloses a protective cover for wedding cakes and other display items that includes a top, sides and a base. Parrish lacks a combination of devices that stabilizes the cake. The base of Parrish lacks provisions to position and secure the sides and platform to the base. The parish device also lacks manufacture using insulated material with provisions for optional passive or active cooling devices. Lastly, Parrish lacks provisions for ease of carrying and avoidance of ruined cakes reaching the landfill to satisfy federal LEEDs standards.

U.S. Pat. No. 3,843,220 to inventor Snider discloses a simulated cake and carrier for cut and wrapped cake pieces that comprises several carrier pieces that look like a cake but when lifted expose the real cake pieces having combined top sides and separate bases. The bases of Snider are disclosed as having recesses to locate the walls of the carrier. However Snider lacks one side of the carrier adapted to be separately opened for sliding the cake into and out of the carrier. Most importantly Snyder lacks the provisions for stabilizing the cake as well as provisions for securing the carrier sides to the carrier base. Snyder lacks provisions for reducing heat flow as well optional passive or active cooling devices. The serious deficiencies of Snyder represent a high probability of causing damaged pastry products reaching the landfill in violation of federal LEEDs standards.

None of the above Patents or Published Patent Applications singly or in combination is seen to describe the present invention as claimed.

BRIEF SUMMARY OF THE INVENTION

Wedding cakes in particular are typically transported from the bakery to the reception hall in a SUV or van. When transported, without protection, wedding cakes stand a very good chance of requiring repair or replacement by the time they reach their destination. Disclosures of known devices suggest that the wedding cake should be transported in individual carriers for each layer followed by assembly of the layers into a cake at the destination. This process requires the baker to do the delivery so that the assembly is done skillfully at the cakes destination making the frosting joined seamlessly where the layers meet. The present invention, under rigorous in service testing, has successfully transported numerous, fully assembled, tall, complicated, wedding cakes under much less than ideal road and travel conditions with no damage.

The present invention also has provisions for safely loading and unloading the cake from the carrier and securing the cake, layer separators and supporting platform to the base. The walls and top of the present invention are insulated in addition to provisions for passive and active cooling devices to keep the cake cool. Provisions for making the carrier easy to move from a vehicle and into a building are also provided. Complete reuse of all components, ease of cleaning and avoidance of ruined cakes reaching the land fill also satisfy some of the requirements in the federal LEEDs standards. This comprehensive solution to transporting pastry products allows the baker to assemble the cake in a clean, well equipped bakery while subsequently allowing unskilled delivery people to competently deliver this fragile cargo to a table at a remote location safely and trouble free.

The primary objective of the present invention is to protect an assembled multiple layer cake with the height approaching or exceeding the width of the base of the cake during transport from the bakery to the reception hall.

A second primary objective of the present invention is to prevent cake damage or disposal due to shifting or tilting of the layers with respect to the base or shifting with respect to each other.

A further objective of the present invention is to provide for easy transfer of the cake into the carrier at the bakery and out of the carrier at the destination.

A further objective of the present invention is to provide access to the member supporting the cake in the carrier without inadvertent hand contact with the frosting.

A further objective of the present invention is to allow separate opening of one side of the carrier allowing easy removal of the cake from the carrier.

A further objective of the present invention is to keep the pastry cool with walls having dead air spaces for thermal insulation and having provisions for optional passive or active cooling devices.

A further objective of the present invention is to fulfill federal LEEDSs standards with complete reuse of all components and prevention of ruined pastry reaching the land fill.

A further objective of the current invention is to provide a "hands free" apparatus and method of lifting and carrying.

BRIEF DESCRIPTION OF THE SEVERAL VIEWS OF THE DRAWING(S)

FIG. 1: Is a assembled view of the present invention being tilted at an extreme angle.

Figure 2:
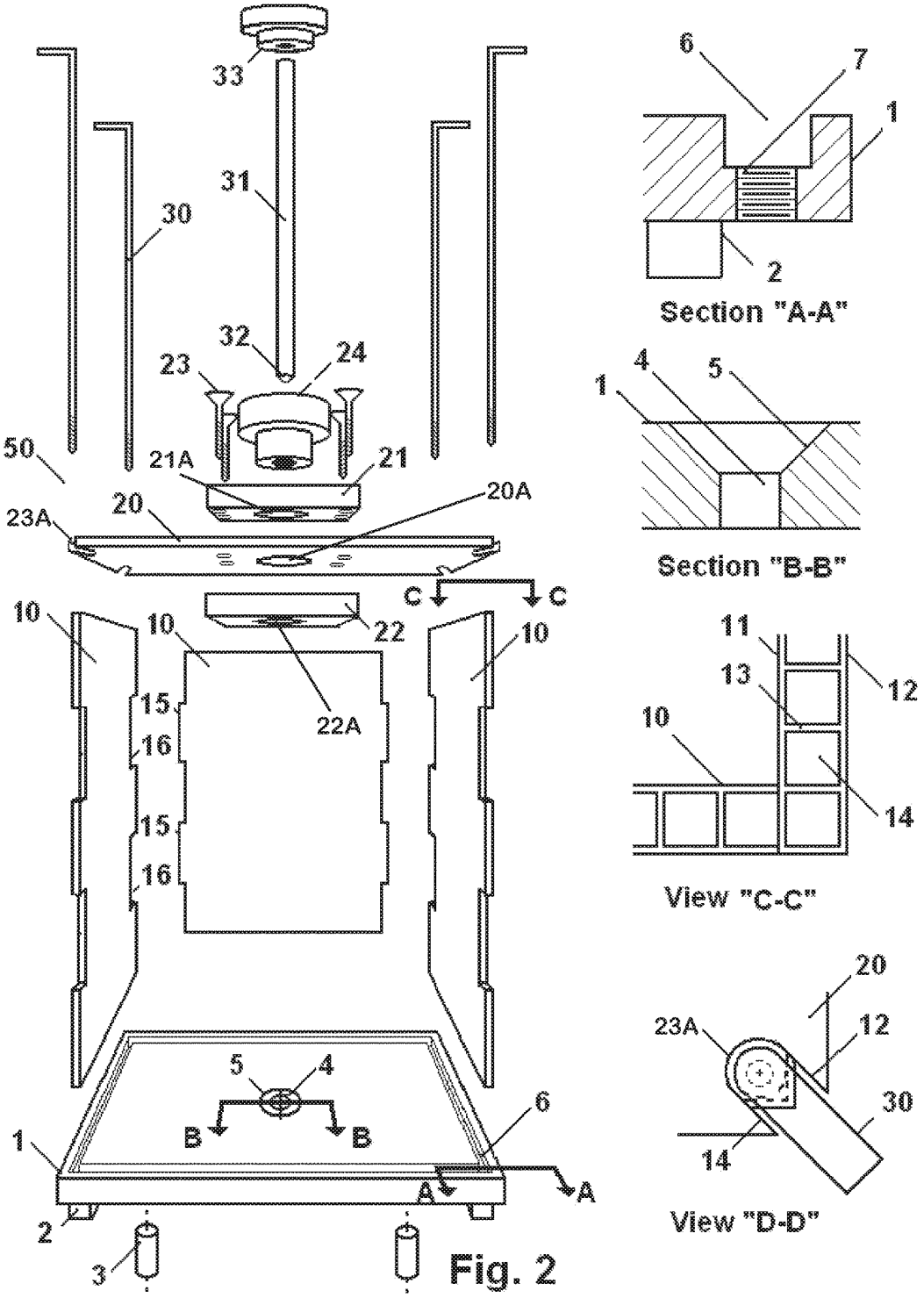

FIG. 2: Is a exploded view of the present invention.

Figure 3:
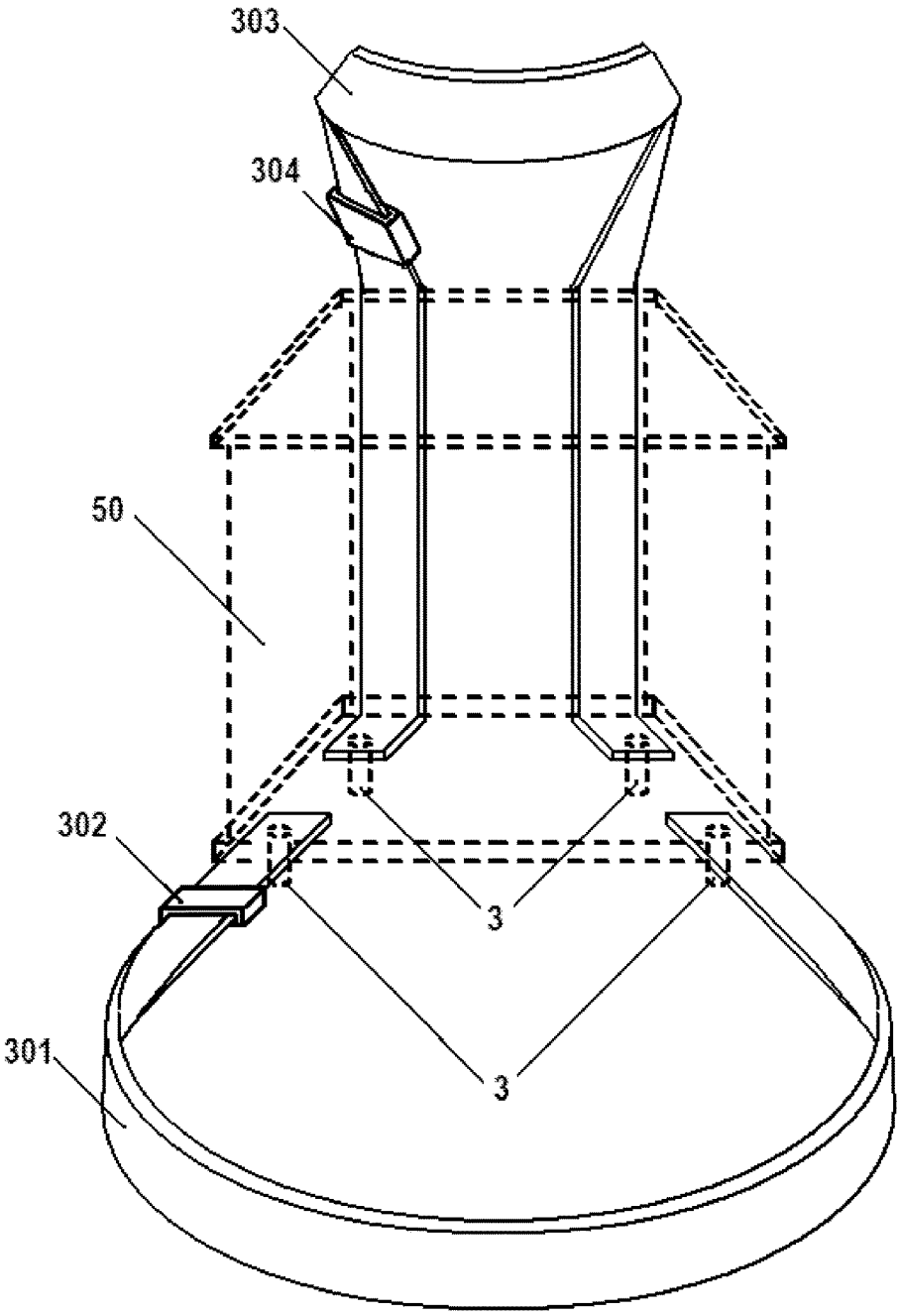

FIG. 3: Is a perspective view of the carrier with a hands free carrying strap.

Figure 4:
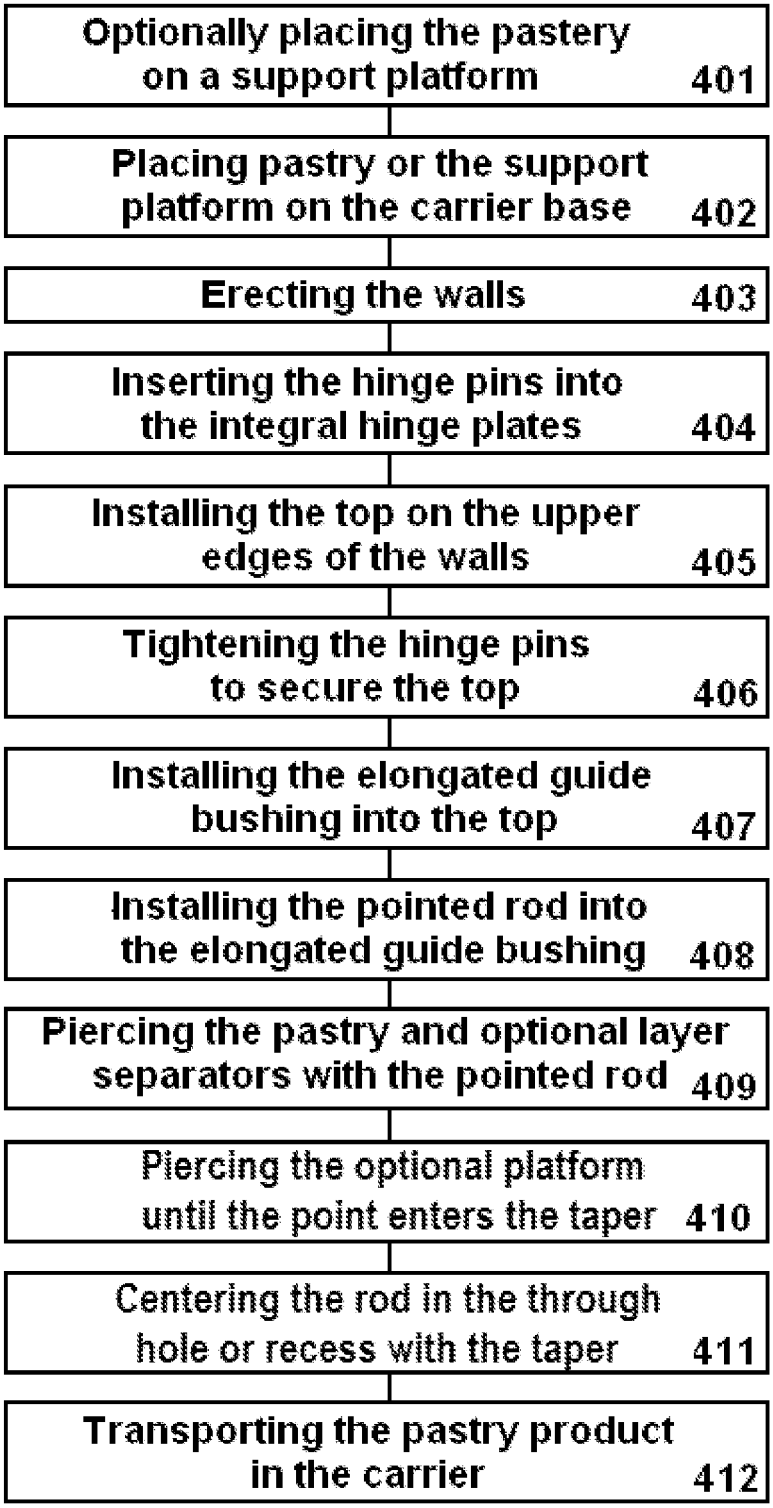

FIG. 4: Is a block diagram of the method for placing the cake in the carrier.

Figure 5:
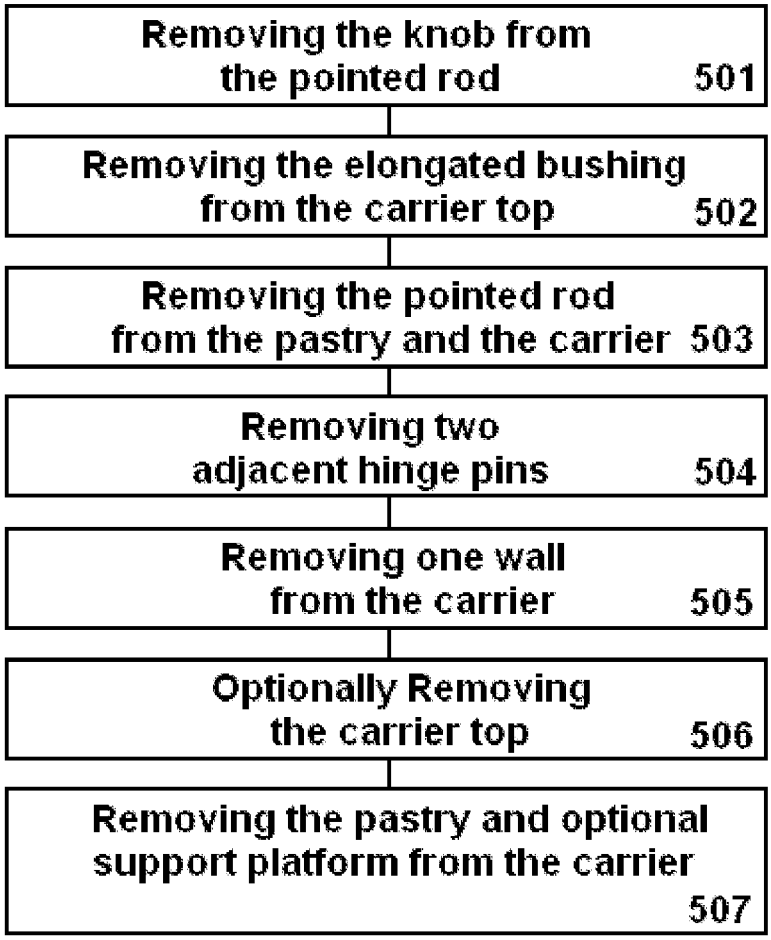

FIG. 5: Is a block diagram of the method for removing the cake from the carrier.

DETAILED DESCRIPTION OF THE INVENTION

FIG. 1 shows a wedding cake 40 supported in the carrier of the present invention 50 being supported at an angle that would typically result in catastrophic damage to the cake. A rod 31 that pierces the cake 40 and is firmly supported above the cake by elongated bushing 24 and at the bottom by hole 4 as well as a novel construction for the carrier container protects the cake for transport in a variety of adverse conditions such as: angular position (as shown), vertical and horizontal acceleration, centrifugal movement, vibratory and environmental conditions.

FIG. 2 shows the carrier base 1, with hand grips 2 (two shown) along the bottom edges of the base 1 and legs 3 (four present). The base 1 also has a recess or through hole 4 surrounded by a taper 5. Section "B-B" shows a detail of the base 1 and recess or through hole 4 surrounded by taper 5. There is a groove 6 located around the edge of the top of base 1 for mounting of the carrier walls 10. Section "A-A" snows a detail of the base 1, hand holds 2, groove 6 and threaded holes 7 at the corners of base 1 for fastening of the walls 10 to the base 1. The walls 10 are further adapted for assembly into a ridged carrier 50 with protrusions 15 along one side and grooves 16 along the opposite side. The walls 10 are made of a polymer or plastic product shown in a cross section taken at a corner of the carrier at view "C-C". Inner wall 11 is separated from outer wall 12 by ribs 13 leaving openings 14 forming dead air space that has thermal insulating value to maintain the temperature of the carrier contents. When protrusions 15 mesh with grooves 16 at a corner and the bottoms of the adjoining walls 10 are properly inserted in the grooves 6 the last of the openings 14 in each of the adjoining walls 10 will line up so that pins 30 can be inserted, thereby holding the walls 10 together as shown in View "D-D". The junction of the walls 10 is further stabilized by engaging the threaded end of pins 30 into the threaded hole 7 in base 1 (Section "A-A") and the handles at the top of the pins 30 are turned to point away from the hole 4 (View "D-D"). After assembling the stiffener parts 21 and 22 onto the carrier cover 20 using screws 23 also referred to as fasteners 23), the cover 20 is placed on top of the walls 10 with the slots 23A in cover 20 nested on top of the pins 30 (that are in the position shown in View "D-D"). Subsequently the pins 30 are rotated until they are snug against the cover 20 and oriented with the handles pointed towards the elongated bushing 24 (180 degrees from position shown in View "D-D". Platform 8 is optionally used to facilitate placement of the cake 40 onto the carrier base 1.

FIG. 3 shows a strap configuration for picking up the carrier 50 from the back of a van or a table top (un-shown) keeping the users hands free. Strap 301 and 303 are captured upon legs 3 at each end of the straps 301 and 303 respectively. While facing the carrier 50 the user (un-shown) opens the buckle 302 places the strap 301 around their waist followed by adjusting and fastening the buckle 302. This is followed by opening buckle 304 placing the strap 303 around their neck and subsequently adjusting and fastening buckle 304.

FIG. 4 is a block diagram of the method of assembling the carrier 50 (referring to the apparatus of FIG. 1) set on a level surface (un-shown)) while placing the cake 40 in the carrier 50 in preparation for transport. The cake 40 optionally will be supported by a support platform 8 made of cardboard or other ridged but pierce-able material at step 401. The process would start at step 402 if the pastry is being directly placed on the base 1. The walls in step 403 would now be slid into the groove 6 of base 1 in a manner where the grooves 16 and protrusions 15 of adjoining walls 10 are meshed together. At step 404 the pins 30 are inserted through the aligned openings 14 (refer to FIG. 2, View "D-D") in the walls 10 and the pins 30 are rotated to engage the threaded holes 7 in base 1 with the curved portion of the pins 30 in the position shown (refer again to FIG. 2, View "D-D"). At step 405 the carrier top 20 is set on top of the walls 10 and the slots 23A in the top 20 are aligned over the curved portion of pins 30 (refer to FIG. 2, View "D-D"). At step 406 the pins 30 are turned until the top is held snugly in place and the curved portion of the pins 30 are turned to point towards the center of the carrier 50. The first time the carrier 50 is assembled or after the carrier 50 is given a thorough cleaning there is a step between step 406 and 407 where the stiffeners 21 and 22 are fastened to the carrier top using fasteners 23 and the knob 33 is fastened to the top of pointed rod 33. FIG. 4 assumes that the stiffeners 21 and 22 and knob 33 are pre-assembled. At step 407 the elongated bushing 24 is slid into the holes in the center of stiffener 21 (stiffener hole 21A), top 20 (top hole 20A) and stiffener 22 (stiffener hole 22A). At step 408 the pointed rod 31 is slid downward into the hole through the elongated bushing 24. The process simply proceeds by dropping the pointed rod 31, which is heavy, into the elongated bushing 24 resulting in step 409 the piercing of the pastry and optional layer separators. At step 410 the pointed rod pierces the optional platform, if any, and the point 4 continues to enter the taper 5 in the base 1. Step 411 continues the downward travel of the pointed rod 31 which is then centered in the through hole or recess 5 through camming action between the point 32 and the taper 5. Once the pointed rod 31 is seated in the through hole or recess 4 the cake 40 may be transported safely in the carrier 50 per step 412.

FIG. 5 shows the method steps of removing the cake 40 from the carrier 50 by opening only one wall 10 of the carrier 50. At step 501 the knob 33 is removed from the pointed rod 31. Followed by step 502 where the elongated bushing 24 is removed from the top 20 and stiffeners 21 and 22. The pointed rod 31 is removed from the cake 40 by gently pulling upward at step 503. Two adjacent pins 30 are removed from a carrier wall 10 at step 504. The wall 10 is removed from the carrier 50 at step 505. The top 20 may be optionally removed at this point making it easier to reach the cake 40. Lastly at step 507 the cake 40 can be easily slid horizontally from the carrier 50. At this point the elongated bushing 24 and pointed rod 31 are separated from the carrier 50 for ease of cleaning. The process steps of FIG. 5 can be performed in reverse order to place the next cake 40 into the carrier 50 through the opening left by the removal of one wall 10 and optionally removal of the top 20.

Although the terms and definitions used in the specification are intended to be read into the claims they are hot intended to limit the meets and bounds of the claims presented here below in any manner whatsoever.

We claim:

1. A carrier for safe transport of a cake having one or more layers, comprising: a cover, the cover comprising a top, a bottom, a plurality of corners and a center, each of the corners comprising a slot, each of the slots diagonally oriented towards the center of the cover;

an upper and lower stiffener attached to the top and bottom of the cover respectively;

a through hole in essentially the center of and passing through the cover and the upper and the lower stiffeners;

a base of substantially planar profile the base comprising a plurality of edges, having near the edges of one side of the base a continuous groove formed in and circumscribing the base, a threaded hole being formed at each corner of the base; and a through hole surrounded by a taper in essentially the center of the base;

a plurality of walls disposed between the cover and the base, the walls comprising an alternating plurality of interlocking protrusions and grooves the walls arranged adjacent one to another where the interlocking protrusions of one wall fit into the interlocking grooves of the adjacent wall where each of the interlocking protrusions has an enclosed opening formed at an edge thereof;

a plurality of pins comprising an elongated rod, a first end of the elongated rod comprising threads and a second end of the elongated rod being bent so as to be essentially a right angle to the elongated rod to form a handle;

each pin extending through one of the slots in the cover and through the openings formed in the edges of the protrusions of the walls, threaded into the threaded hole in the base, at least one of the slots communicating with an outer periphery of the cover; and a center rod, wherein the center rod extends through the through hole in the cover, through the cake disposed in the carrier, and engages the through hole surrounded by the taper in the base.

2. The carrier of claim 1, wherein: the cover is adapted to be separated from the walls.

3. The carrier of claim 1, wherein:

the walls of the carrier are adapted to reduce the flow of heat.

4. The carrier of claim 3, further comprising:

a dead air space formed between an inner wall and an outer wall of the walls.

5. The carrier of claim 4, wherein:

the inner wall is an inner polymer wall, the outer wall is an outer polymer wall, and polymer ribs are disposed between the inner wall and the outer wall.

6. The carrier of claim 5, wherein:

the wall openings for receiving the pin are formed in the dead air space of the walls.

7. The carrier of claim 1, wherein:

the plurality of protrusions and grooves are formed integral in one piece with the walls.

8. The carrier of claim 1, wherein:

the through hole in essentially the center of the cover is adapted to guide the center rod to a position for engagement with the base opening.

9. The carrier of claim 8, further comprising:

an elongated bushing disposed about the through hole in essentially the center of the cover configured to guide the center rod for engagement with the through hole surrounded by a taper in essentially the center of the base.

10. The carrier of claim 1, wherein:

the through hole surrounded by a taper in essentially the center of the base and the end of the center rod engaging the through hole surrounded by a taper in essentially the center of the base is adapted to self center the rod in the through hole surrounded by a taper in essentially the center of the base, and;

the through hole surrounded by a taper in essentially the center of the base is formed at the time of manufacture.

11. The carrier of claim 10, wherein:

the end of the center rod engaging the through hole surrounded by a taper in essentially the center of the base is pointed.

12. The carrier of claim 11, wherein:

the center rod and the through hole surrounded by a taper in essentially the center of the base have cylindrical portions that are engaged when the rod is fully inserted into the cake and the carrier.

13. The carrier of claim 1, wherein:

the carrier is adapted with one or more straps for hands free carrying.

14. A method of using the carrier of claim 1 for safe transport of a cake having one or more layers, comprising the steps:

Disposing the ends of each wall into the grooves of the base, fitting the protrusions of one wall into the grooves of an adjacent wall;

inserting the plurality of pins through the slots in the cover disposed atop the walls, the pins fitting into the enclosed channels formed through the protrusions of adjacent walls, securing one wall to its adjacent wall, at least one of the slots communicating with an outer periphery of the cover;

threading the pins into the threaded holes disposed at corners of the base; disposing the cake on the base;

inserting the center rod into the through hole in the cover of the carrier; piercing the cake with the rod;

inserting the rod further into the through hole surrounded by a taper in essentially the center of the base of the carrier; resting the rod in a position where the rod and the through hole surrounded by a taper in essentially the center of the base are in engagement.

15. The method of claim 14, further comprising threading the pins into the threaded holes, where the pins have an angled end securing the cover onto the walls.

* * * * *